US005211353A

United States Patent [19]

Lewin et al.

[11] Patent Number: 5,211,353

[45] Date of Patent: May 18, 1993

[54] SPOOL WITH AN INTEGRAL BOBBIN HOLDER

[76] Inventors: Menahem Lewin; Shirley Lewin, both of 43 Rte. 40, E. Jewett, N.Y. 12424

[21] Appl. No.: 857,475

[22] Filed: Mar. 25, 1992

[51] Int. Cl.[5] ..... B65H 75/18

[52] U.S. Cl. ..... 242/118.41

[58] Field of Search ..... 242/118.41, 118.4

[56] References Cited

U.S. PATENT DOCUMENTS 358,705 3/1887 Smith ..... 242/118.41

2,065,072 12/1936 Hertzka ..... 242/118.41 X 3,854,673 12/1974 Manning ..... 242/118.41

*Primary Examiner*—Stanley N. Gilreath

[57] ABSTRACT

A spool for thread with a self contained bobbin holder. A contrivance consisting of a spool with a self contained bobbin holder is described. The invention is based on the fact that the core of the spool is projected beyond the edge of the spool creating a protuberance which functions as a receptacle for the bobbin, allowing the contrivance to temporarily store the mated spool and bobbin for quick and easy retrieval.

5 Claims, 1 Drawing Sheet

SPOOL WITH AN INTEGRAL BOBBIN HOLDER

FIELD OF INVENTION

The present invention deals with the thread winding arts, specifically with the temporary storage of a spool of thread and a bobbin using the same type and color thread after such use in a sewing machine, until its reuse is required. The invention permits an easy and efficient means of attachment and a convenient method of storage of the two units, thereby preventing loss or misplacement. This results in an efficient method of retrieval of the mated pair when required for further use.

SUMMARY OF INVENTION

It is the object of this invention to provide a bobbin-holder apparatus for attaching a spool of thread directly to a bobbin using the same type and color of thread thereby storing the pair conveniently and making the retrieval of the pair quick, easy and efficient, and thereby eliminating misplacement or loss of either unit resulting in saving time for the operator.

A further objective of the invention is to provide the operator of a sewing-machine the opportunity to purchase an inexpensive apparatus which will connect and hold the spool and bobbin together in a single unit.

The advantages of this invention are inherent but were unrecognized by those skilled in the art; it solved the needs stated above.

REFERENCE NUMERALS IN DRAWING:

5—Receptor thread spool
**5*a***—Receptor spool of thread
6—Tubular core of receptor spool
7—Hollow tapered protuberance which is an extension of the receptor spool's core
8—Edge or flange of receptor spool
9—Supporting platform for the protuberance
10—Engaging bobbin
11—Notches in edge or flange of receptor spool used as thread catchers

Figure 1:
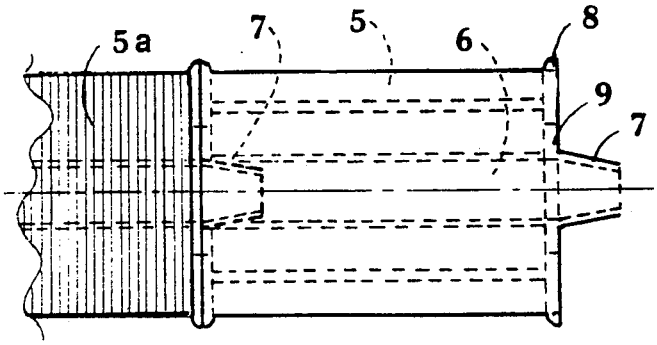
FIG. 1 is an elevational view of the invention. The tapered hollow-cored protuberance (#7) is an extension of the hollow cylindrical core (#6) of the receptor spool of thread (#5) shown attached to another receptor spool's (#5*a*) edge (#8).
Figure 2:
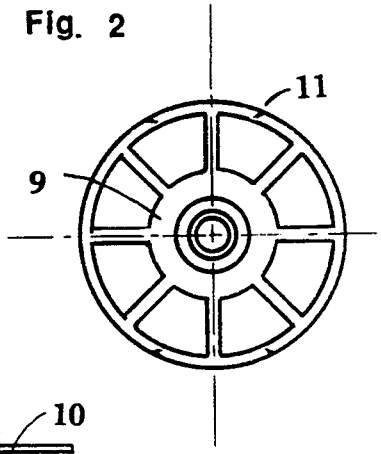
FIG. 2 is an end view and shows the tapered, hollow-cored protuberance (#7) attached to the supporting platform (#9) and the notches (#11) which function as thread catchers.
Figure 3:
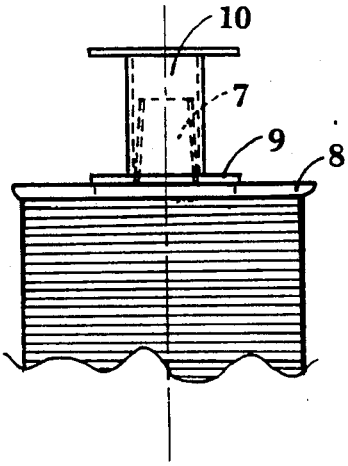
FIG. 3 is a partial elevational view showing the tapered protuberance (#7) wedged into an engaging bobbin (#10) and held in place frictionally.
Figure 4:
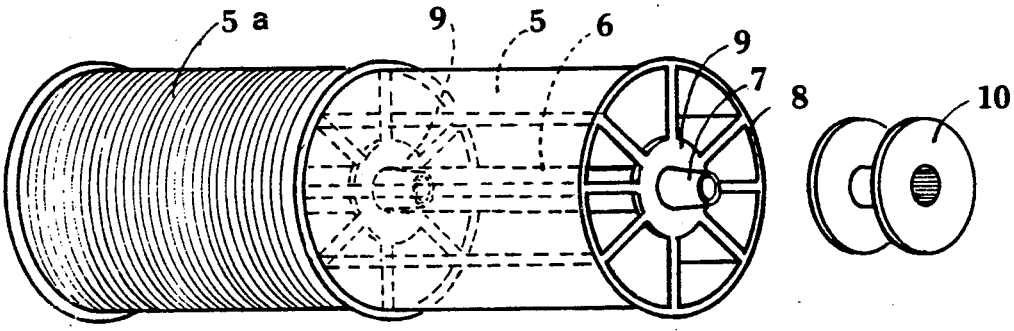
FIG. 4 is a partial exploded perspective view showing two receptor spools (#5 & #5*a*) attached to each other end to end, with the tapered protuberance (#7) of the receptor spool (#5) in position to accept the engaging bobbin (#10).

The receptor spool (#5) includes an elongated body portion having edges or flanges (#8) at opposed ends thereof and a central hollow cylindrical core (#6) open at both ends and extending through the body portion and the edges or flanges, which accommodates the sewing machine spindle, when being used in a sewing machine mode. In addition, the receptor spool (#5) has an open ended hollow protuberance (#7) attached at one end from the edge or flange (#8) of the spool, and is all of an integral unitary construction. The protuberance (#7) is slightly tapered into a conical shaped form providing a firm friction surface, allowing the exterior wall of the protuberance (#7) which is composed of a lower density resilient plastic material than the engaging bobbin (#10) which is made out of a higher density material, to be wedged into the engaging bobbin (#10). The conical shaped protuberance is formed as an extension of the hollow cylindrical core with the large diameter end of the protuberance being the same diameter as the hollow/cylindrical core. The protuberance (#7) functions as the vehicle of attachment between the receptor spool (#5) and the engaging bobbin (#10). The tapered protuberance (#7) is further supported by a supporting platform (#9) providing additional strength. The edge or flange of the receptor spool (#5) includes inclined cuts (#11) sufficiently deep to act as thread catchers. These conveniently secure the loose thread ends of both the receptor spool's (#5) and the engaging bobbin (#10). The receptor spool's (#5) protuberance (#7) is also capable of being attached in series for efficient packaging, shipping and storage of multiple spools by the process of interlocking them.

We claim:

1. A thread spool with a spool or bobbin holder, said thread spool comprising an elongated body portion, a hollow cylindrical core open at both ends and extending through the body portion, and a hollow conical protuberance extending from the body portion and being an extension of the hollow cylindrical core with the large diameter end of the protuberance being the same diameter as the cylindrical core, whereby a second spool or a bobbin is capable of being attached in series with the thread spool by a hollow core of the second spool or bobbin frictionally engaging said conical protuberance.

2. A thread spool as described in claim 1 wherein said spool body, said hollow cylindrical core and said conical protuberance are an integral, unitary construction.

3. A thread spool as described in claim 1, said thread spool further including an edge or flange at each end of the body portion.

4. A thread spool as described in claim 3, further including in claim 2, further including inclined cuts or notches in at least one of the edges or flanges for securing a thread end.

5. A thread spool as described in claim 1, further including a platform for the conical protuberance for providing additional strength thereto.

* * * * *